United States Patent [19]

Pettersson et al.

[11] Patent Number: 4,611,540

[45] Date of Patent: Sep. 16, 1986

[54] MORTAR AMMUNITION

[75] Inventors: Rolf T. Pettersson; Hans G. U. Edlund; Bengt I. C. Regebro, all of Eskilstuna, Sweden

[73] Assignee: Affarsverket FFV, Eskilstuna, Sweden

[21] Appl. No.: 577,708

[22] Filed: Feb. 7, 1984

[30] Foreign Application Priority Data

Feb. 9, 1983 [SE] Sweden ..... 8300662

[51] Int. Cl.[4] ..... F42B 15/00

[52] U.S. Cl. ..... 102/372; 102/374

[58] Field of Search ..... 102/372, 374, 520–523, 102/373; 89/1.3, 1.35, 1.7

[56] References Cited

U.S. PATENT DOCUMENTS

| | | | |
|---|---|---|---|
| 2,447,971 | 8/1948 | Weinert . | |
| 2,657,630 | 11/1953 | Blacker | 102/372 |
| 2,901,973 | 9/1959 | Donner | 102/372 |
| 2,944,486 | 7/1960 | Jasse . | |
| 3,120,151 | 2/1964 | Jasse | 89/1.3 |
| 4,388,868 | 6/1983 | Frostig | 102/372 |

FOREIGN PATENT DOCUMENTS

| | | | |
|---|---|---|---|
| 1176026 | 8/1964 | Fed. Rep. of Germany . | |
| 583484 | 12/1946 | United Kingdom | 102/372 |
| 662429 | 12/1951 | United Kingdom | 102/372 |

*Primary Examiner*—Harold J. Tudor

*Attorney, Agent, or Firm*—Fleit, Jacobson, Cohn & Price

[57] ABSTRACT

Mortar ammunition with a projectile body and a tail tube containing the necessary propellant charge. The tail tube and the projectile body constitute two separate components which, for the purpose of being loaded into the mortar, are capable of being lowered in turn into the mortar via its barrel until they come into contact with each other inside the barrel. When the mortar is fired the projectile body will leave the mortar without taking with it the tail tube. The projectile body and the tail tube make contact with each other via a girdle fixed to the tail tube, said girdle being caused by the gases from the propellant charge to become detached from the tail tube and to become securely attached to the projectile body, so that the girdle is carried out of the barrel by the projectile body.

3 Claims, 4 Drawing Figures

MORTAR AMMUNITION

The present invention relates to mortar ammunition with a projectile body and with a tail tube containing the necessary propellant charge.

Projectiles for mortars usually exhibit a tail section rigidly combined with the projectile and in the form of a cartridge tube, around which are arranged wings or guide fins, and which encloses an ignition and propellant cartridge containing a suitable gunpowder. In addition to said cartridge a further quantity of gunpowder may be arranged on the outside of the cartridge tube, usually in the form of a number of incremental charges. The cartridge tube is provided with a number of transcurrent holes to enable the gases from the gunpowder to be exhausted. The gases not only impart a propulsion force to the projectile, but also provide the necessary ignition impulse for any incremental charges which may be present on the outside of the cartridge tube.

In such projectiles energy is expended on the acceleration of both the projectile body and the cartridge tube, since these components are rigidly connected to each other. The present invention is based on the novel approach that it is possible to cause the projectile body and the cartridge tube to constitute two separate components, said cartridge tube not being carried with the projectile body when the latter is fired from the mortar. The resulting benefit is that additional energy may be used for firing the projectile body.

BRIEF DESCRIPTION OF THE DRAWINGS

The invention will be described in greater detail below with reference to the accompanying drawing which illustrates a preferred embodiment of the invention.

DETAILED DESCRIPTION OF THE PREFERRED EMBODIMENTS

Figure 1:
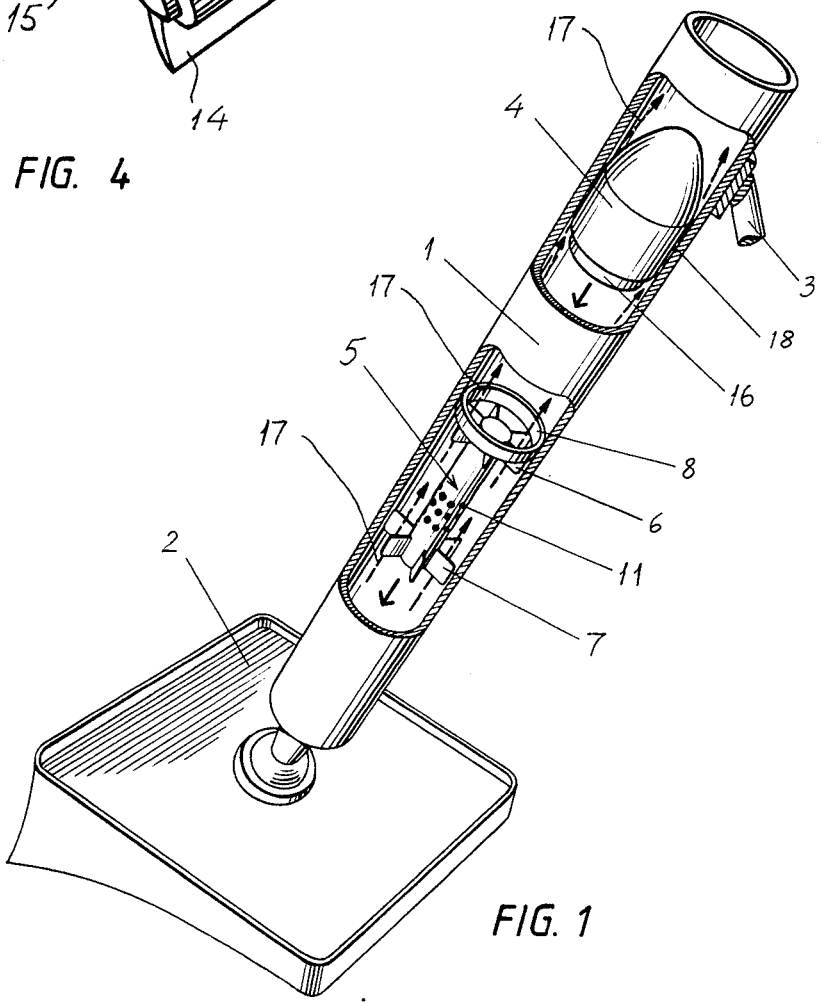
FIG. 1 shows in perspective view a mortar of which the barrel is partly cut away in order to reveal the two component parts of the ammunition on their way down into the barrel during the loading phase.

The mortar illustrated in FIG. 1 comprises a barrel 1, preferably with a smooth bore, a base plate 2 and a cradle 3, only a suggestion of which is given in the Figure. The associated shell consists in accordance with the invention of a projectile body 4 containing amongst other things an active load such as a propulsion means and/or an explosive charge of a type not illustrated in detail, and of a tail tube in the form of a cartridge tube 5 with a conventional, but not illustrated, propellant charge for firing the shell.

The explosive charge may, for instance, comprise an explosive charge with a hollow-charge effect. Since such explosive charges are already generally familiar as such, it is not considered necessary to describe them in any more detail here. The propulsion means is also a component which is well known to those skilled in the art, for which reason it is not described here in any greater detail. The propellant charge may be in the form of an ignition and propellant cartridge of the type referred to above by way of introduction. Since such propellant charges are already generally familiar, it is not considered necessary to describe them in any greater detail here.

For drafting purposes the projectile body 4 is shown in FIG. 1 to be of relatively short length, whereas its length will normally be very much greater than its calibre.

Figure 2:
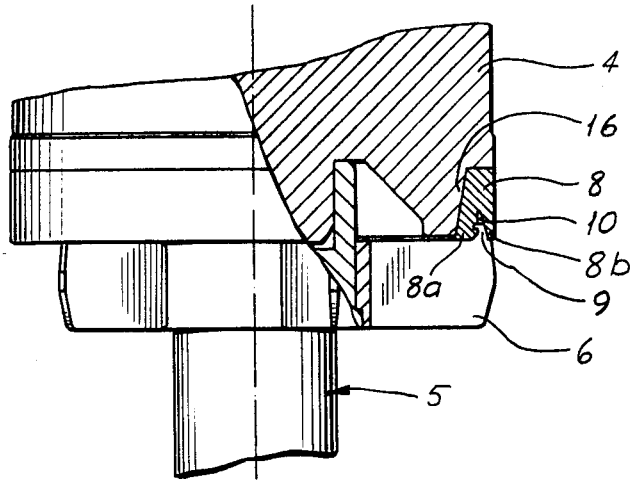
FIG. 2 shows a lengthwise view, partly in section, of how the two component parts of the ammunition make contact with each other in a loaded position inside the barrel.

The cartridge tube 5 is provided at its ends with arms 6, 7 in two star-shaped arrangements so as to permit the tube to be centered in the barrel 1. These centering arms, of which one group 7 is attached to the rear end of the cartridge tube 5 and of which the other group 6 is attached to the front end of the cartridge tube, are made in the form of plates of mutually identical shape within the groups, said plates projecting radially from the tube 5. The front centering arms 6 also serve the purpose of retaining a girdle 8 during the charging phase. Accordingly the arms are provided with hooks 9 (see FIGS. 2 and 3) facing inwards towards the central axis of the cartridge tube, said hooks together forming a means of attachment for the annular girdle.

The girdle 8 has an outer, cylindrical surface having a diameter such that it forms a good seal with the internal wall of the barrel 1 but without causing its free movement to be impaired. The purpose of the girdle is to form a seat for the projectile body 4 when the latter is lowered into the barrel 1, for which purpose it is provided with a conical internal surface of identical form to that of the rear end of the projectile body 4.

The girdle 8 also forms a sealing means, the purpose of which is to protect vulnerable parts of the projectile body 4 against the gases from the propellant charge. The girdle may be manufactured from polytetrafluorethylene, for example.

The girdle 8 is a so-called lip girdle, that is to say its end which faces the bottom of the barrel is provided with a groove 10 of essentially wedge-shaped section. The walls of the groove form two annular lips **8*a* and 8*b*. The hooks 9 are introduced into and are retained inside the groove 10**.

The cartridge tube 5 contains in a previously disclosed fashion a propellant charge (not shown), the gases from which can be exhausted via holes 11 in the tube 5. In order to increase the range of the weapon, incremental charges may, also in a previously disclosed fashion, be attached to the cartridge tube 5 before the projectile is lowered into the barrel 1.

Figure 4:
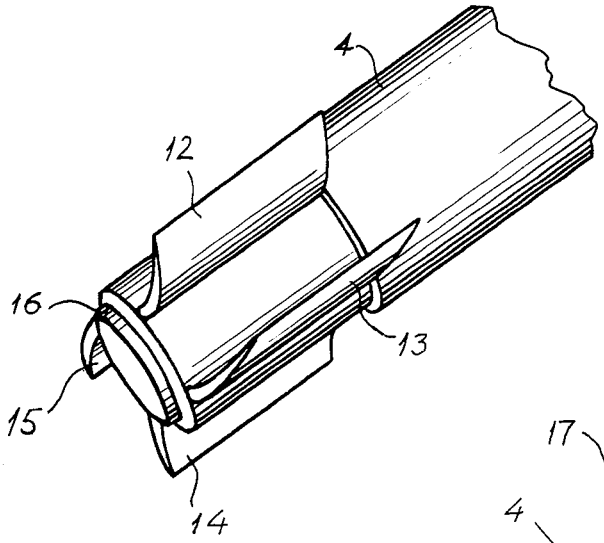
FIG. 4 shows in perspective view the rear part of the projectile body of the ammunition after this has been fired from the mortar.

The projectile body 4 is in accordance with the invention provided with four stabilizing fins 12–15, see FIG. 4, of the type previously disclosed in conjunction with fin-stabilized projectiles. In the embodiment shown these are of the type known as wrap-around fins, that is to say fins which, in the collapsed state, largely coincide with the shape of the outside surface of the projectile. The fins, which are shown in FIG. 4 in their extended state, are so dimensioned as to be extended outwards by a combination of centrifugal forces and the forces generated by the passage of the projectile through the air, whereupon they are locked in a similarly previously disclosed fashion in their extended position.

The rear end of the projectile body 4 exhibits an annular rearward-tapering shoulder 16 having an identical external dimension to the internal dimension of the girdle 8, thereby enabling the girdle in the aforementioned manner to form a seat for the projectile body.

The ammunition in accordance with the invention is loaded into the barrel in the following manner. The cartridge tube 5 is first lowered into the barrel via its muzzle; see FIG. 1. The projectile body 4 is then lowered into the barrel via its muzzle. The effect of gravity causes both components 4 and 5 to move downwards through the barrel in the direction of the unbroken arrows until they strike each other and then make contact with each other in a loaded position at the bottom of the barrel 1. This will cause the shoulder 16 of the projectile body to penetrate into the girdle 8, against it will make loose contact.

In accordance with an alternative embodiment the shoulder 16 exhibits an external diameter greater than the internal dimension of the girdle 8, whereby the shoulder 16 engages in and is held by the girdle, thereby causing the latter to expand slightly and improving its sealing effect against the wall of the barrel 1.

Figure 3:
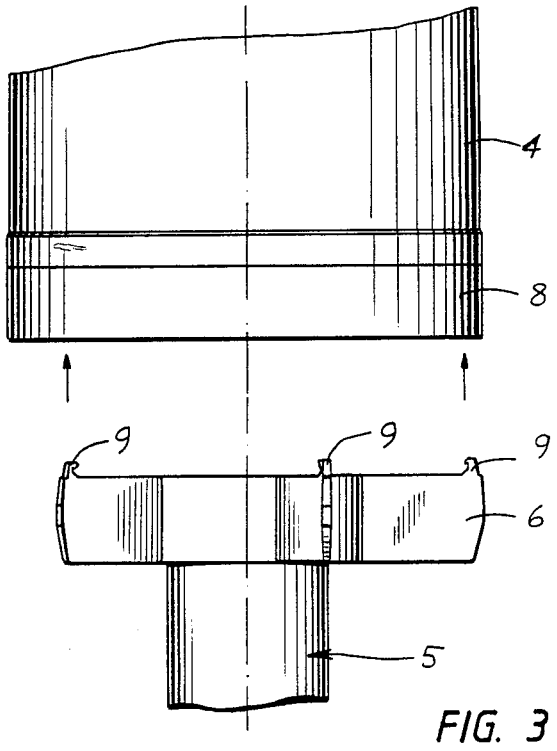
FIG. 3 shows a lengthwise view of the two component parts of the ammunition immediately after the mortar is fired.

On firing, the propellant charge is ignited by, for instance, a fuse in the base of the cartridge tube 5, which can be actuated in a previously disclosed fashion, for example by means of a firing cord or electrically. The propellant gases thus generated are exhausted through the holes 11 in the cartridge tube into the surrounding space, where a gas pressure is built up which is exerted on the rear face of the projectile body 4 and on the rearwardfacing end surface of the girdle 8. The lips 8*a* and 8*b* of the girdle are thus caused to spread by the gases so that their engagement with the hooks 9 of the cartridge tube is released, at the same time as the gases force the lip 8*a* against the shoulder 16 and the lip 8*b* against the wall of the barrel. The girdle will thus accompany the projectile body 4 as it is expelled from the barrel, as shown in FIG. 3. As soon as the projectile body 4 has left the muzzle of the barrel, and as soon as the gas pressure behind the projectile body has dropped, the lips 8*a* and 8*b* will close slightly enabling the girdle to fall from the projectile body.

In the embodiment described above the girdle 8 is securely attached to the cartridge tube 5 during the loading phase. This is a benificial feature, as it prevents the formation of air pockets ahead of the descending ammunition components 4 and 5 capable of slowing down the projectile during the loading phase, viewed in the direction in which they are descending. The air does, in fact, find its way past the cartridge tube through passageways between the arms 6 and 7 and via the inside of the girdle 8, in this case through an annular orifice 18 between the projectile body 4 and the wall of the barrel 1. The air passageways are shown as broken arrows 17 in FIG. 1.

The expression projectile body used in this patent shall also be understood to denote such components providing a rearward extension of the projectile, for example propulsion motors, as are capable of being connected to the rear of a projectile body.

In the embodiment shown, the cartridge tube remains inside the barrel when the mortar is fired. It is possible, however, to achieve the automatic ejection of the cartridge tube from the barrel in such a way as to permit the mortar to be re-loaded. However, since such ejection does not constitute part of the present invention, it is not described here.

We claim:

1. Mortar ammunition for a mortar having a barrel, said mortar ammunition comprising:

a projectile body, a tail tube for containing a propellant charge, an annular girdle, attachment means for securely attaching said annular girdle and said tail tube, said tail tube attached to said annular girdle and said projectile body constitute two separate components which, for the purpose of being loaded into the mortar, are lowered in turn into the mortar via a muzzle of its barrel until said projectile body and said annular girdle come into contact with each other inside the barrel, and mounting means for mounting said annular girdle on said projectile body, said mounting means including an annular shoulder defined by a rear end of the projectile body for engaging in and making contact with said girdle when the projectile body is lowered towards the tail tube in the barrel, said mounting means further including a portion of said annular girdle which corresponds in shape to the external shape of the annular shoulder, and under the effect of gases produced when the propellant charge is ignited, said annular girdle ruptures its attachment with the tail tube and at the same time mounts itself securely on said annular shoulder of the projectile body so that the girdle is carried by the projectile body out of the barrel of the mortar.

2. Ammunition in accordance with claim 1, wherein the girdle is a lip girdle including lips, said lips, in one condition, exert a grip on a number of hooks arranged on the tail tube, said hooks thus retaining the girdle and the lips, when in another condition, brought about by the gases from the propellant charge, release their grip on said hooks.

3. Ammunition in accordance with claim 1, wherein said girdle includes two spaced circular lips and said tail tube includes a number of hooks, said two spaced circular lips gripping said hooks in one condition to retain said girdle and said two spaced circular lips, when in another condition, brought about by the gases from the propellant charge, release their grip on said hooks.

* * * * *